US005243356A

United States Patent [19]

Hama

[11] Patent Number: 5,243,356

[45] Date of Patent: Sep. 7, 1993

[54] ANTENNA CIRCUIT AND WRIST RADIO INSTRUMENT

[75] Inventor: Norio Hama, Suwa, Japan

[73] Assignee: Seiko Epson Corporation, Tokyo, Japan

[21] Appl. No.: 870,160

[22] Filed: Apr. 15, 1992

Related U.S. Application Data

[63] Continuation of Ser. No. 477,867, Apr. 4, 1990, abandoned.

[30] Foreign Application Priority Data

| | | | |
|---|---|---|---|
| Aug. 5, 1988 | [JP] | Japan | 63-196833 |
| Dec. 12, 1988 | [JP] | Japan | 63-313340 |
| Jun. 29, 1989 | [JP] | Japan | 1-67372 |
| Jul. 6, 1989 | [JP] | Japan | 1-75168 |

[51] Int. Cl.[5] ..... H01Q 1/270; H01Q 1/440; H01Q 7/000

[52] U.S. Cl. ..... 343/718; 343/720; 343/744; 343/748; 343/868

[58] Field of Search ..... 343/718, 720, 741, 744, 343/748, 866, 868; 455/344, 274, 289–291; 368/10

[56] References Cited

U.S. PATENT DOCUMENTS

| | | | |
|---|---|---|---|
| 3,571,720 | 3/1971 | Heagney | 325/390 |
| 3,622,887 | 11/1971 | Byles | 325/362 |
| 3,736,591 | 5/1973 | Rennels et al. | 343/702 |
| 3,878,467 | 4/1975 | Manson | 325/316 |
| 3,946,397 | 3/1976 | Irwin | 343/788 |
| 3,980,952 | 9/1976 | Rapshys | 325/16 |
| 4,121,218 | 10/1978 | Irwin et al. | 343/702 |
| 4,201,960 | 5/1980 | Skutta et al. | 333/17 |
| 4,584,713 | 4/1986 | Bruckert et al. | 455/277 |
| 4,713,808 | 12/1987 | Gaskill et al. | 343/718 |
| 4,789,866 | 12/1988 | Ohe et al. | 343/866 |
| 4,799,034 | 1/1989 | Silverman et al. | 333/202 |
| 4,862,516 | 8/1989 | Macnak et al. | 343/718 |
| 4,873,527 | 10/1989 | Tan | 343/718 |
| 4,881,082 | 11/1989 | Graziano | 342/432 |
| 4,885,802 | 12/1989 | Ragan | 455/344 |
| 4,903,326 | 2/1990 | Zakman et al. | 455/89 |
| 4,940,992 | 7/1990 | Nguyen et al. | 343/803 |
| 4,977,616 | 12/1990 | Linder et al. | 455/277 |
| 5,007,105 | 4/1991 | Kudoh et al. | 455/344 |

FOREIGN PATENT DOCUMENTS

| | | | |
|---|---|---|---|
| 0308935 | 3/1989 | European Pat. Off. . | |
| 0033163 | 11/1971 | Japan | 343/718 |
| 0005932 | 2/1973 | Japan | 343/718 |
| 132284 | 2/1981 | Japan | 343/718 |
| 167351 | 7/1981 | Japan | 343/718 |
| 0008194 | 1/1983 | Japan | 343/718 |
| 158924 | 7/1988 | Japan | 370/94.1 |
| 8805213 | 7/1988 | World Int. Prop. O. | 343/718 |

*Primary Examiner*—Rolf Hille
*Assistant Examiner*—Peter Toby Brown
*Attorney, Agent, or Firm*—Raymond J. Werner

[57] ABSTRACT

The antenna circuit and wrist radio instrument of the present invention compensates for slippage in the resonance frequency of antenna circuits caused by such as the wrist thickness of the person wearing them, and by being worn on the wrist and then not worn, and can always tune to a set frequency. Accordingly, the present invention is one that can automatically receive a set frequency signal stably and with a set sensitivity, with no need for special adjustments.

1 Claim, 8 Drawing Sheets

ANTENNA CIRCUIT AND WRIST RADIO INSTRUMENT

This is a continuation of copending application Ser. No. 07/477,867 filed Apr. 4, 1990, now abandoned.

FIELD OF THE INVENTION

The present invention relates to small model portable radio instruments such as receivers, transceivers, pocket bells and pagers, and in particular relates to effective technology for application to their antenna circuits and to wrist radio instruments having these antenna circuits.

BACKGROUND TECHNOLOGY

There are prior examples where variable capacity diodes were installed in the antenna circuits of portable small model radio instruments, in order to eliminate dispersion of the resonance frequencies of antenna circuits during mass production. However, in these instances, once the resonance frequencies have been corrected with the variable capacity diodes, there is no slippage in the resonance frequencies thereafter, so that the variable capacity diodes are used passively, so to speak.

On the other hand, variable capacity diodes are used with small model radio instruments that are capable of receiving continuously in a certain frequency range, because it is necessary to change the resonance frequency of the antenna circuit continuously. However, they are not used for purposes of correction when there is slippage in the resonance frequency of the antenna circuit for some reason, and there is almost no slippage in the frequency.

Further, the AFC (Auto Frequency Control) circuit system is a system for obtaining stabilized sending and receiving signals, and also uses variable capacity diodes for correction of slippage in signal frequency, but since this is something that corrects the oscillation frequency of the local oscillator in a superheterodyne system, it differs in purport from the present invention.

The present invention applies to an antenna circuit having a loop antenna integrated in a wrist band for wearing on the wrist, and to a wrist radio instrument.

That is, because the loop antenna is worn in a form where it circumscribes the wrist, the length of the loop antenna changes depending on the individual user. Since this means that the inductance value of the loop antenna changes depending on the individual, the resonance frequency of the antenna circuit has changing values depending on the individual, leading to dispersion in the gain of the loop antenna. This has an effect on the sensitivity of the radio instrument of each individual, and when there is severe slippage in the resonance frequency, there is likelihood that sending and receiving signals will become impossible.

On the other hand, after the loop antenna has been placed on the wrist, there is slippage in the resonance frequency from the effect of the human body. This fact means that even if signals can be raised when it is not worn on the wrist, there is a possibility that signals cannot be raised once it is worn.

Since this development arises because of slippage in the resonance frequency of the antenna circuit, we may say that the resonance frequency should be restored to its original form, but having the user of the loop antenna make hand adjustments to do this would be very troublesome and unrealistic.

Here, the object of the present invention lies in offering an antenna circuit capable of correcting slippage in the resonance frequency of the antenna circuit automatically, and maintaining the resonance frequency constantly at a set frequency.

Also, the wrist radio instrument of the present invention, provided with such an antenna circuit, is capable of sending and receiving signals at a constantly set sensitivity, without regard to the wrist thickness of the individual user, and without regard to whether it is being worn on the wrist or not.

DISCLOSURE OF THE INVENTION

The antenna circuit of the present invention, within a) an antenna circuit wherein a loop antenna integrated in a wrist band for wearing on the wrist and a condenser connected to the said loop antenna resonate at a specified frequency, characterized in b) a connector construction wherein a connector part that has a means of detaching a part of the said loop antenna for removal from the wrist has an electric coupling capacity, and automatically changes the said coupling capacity in correspondence with changes in the length of the said loop antenna.

Further, when such an antenna circuit is attached to a wrist radio instrument, the wrist radio instrument is constructed so that both are made as one body.

Also, within a) an antenna circuit having properties such that a loop antenna formed as one body with a wrist band for wearing on the wrist and a condenser connected to the said loop antenna resonate at a specific frequency, characterized in furnishing b) a variable capacity diode connected to the said antenna circuit, and c) a voltage generator that generates the applied direct current voltage of the said variable capacity diode, in order to change the capacity of the said variable capacity diode at any time, in correspondence with the length of the said loop antenna.

Further, when such an antenna circuit is attached to a wrist radio instrument, the wrist radio instrument is constructed so that both are made as one body.

Also, within a) an antenna circuit having properties such that a loop antenna formed as one body with a wrist band for wearing on the wrist and a condenser connected to the said loop antenna resonate at a specific frequency, characterized in furnishing b) a variable capacity diode connected to the said antenna circuit, and c) a voltage generator that generates the applied direct current voltage of the said variable capacity diode, in order to change the capacity of the said variable capacity diode at any time, when the said loop antenna is worn on the wrist and when not worn.

Further, when such an antenna circuit is attached to a wrist radio instrument, the wrist radio instrument is constructed so that both are made as one body.

Also, within a) an antenna circuit having properties such that a loop antenna formed as one body with a wrist band for wearing on the wrist and a variable capacity diode connected to the said loop antenna resonate at a specific frequency, characterized in b) having a connector construction where a connector part having a means of wrist mounting by detaching a part of the said loop antenna has an electric coupling capacity, and the said coupling capacity is automatically changed in correspondence with the length of the said loop antenna.

Further, when such an antenna circuit is attached to a wrist radio instrument, the wrist radio instrument is constructed so that both are made as one body.

Also, within a) an antenna circuit having properties such that a loop antenna formed as one body with a wrist band for wearing on the wrist and a first variable capacity diode connected to the said loop antenna resonate at a specific frequency, characterized in furnishing b) a second variable capacity diode connected to the said antenna circuit, and c) a voltage generator that generates the applied direct current voltage of the said second variable capacity diode, in order to change the capacity of the said second variable capacity diode at any time, in correspondence with the length of the said loop antenna.

Further, when such an antenna circuit is attached to a wrist radio instrument, the wrist radio instrument is constructed so that both are made as one body.

Also, within a) an antenna circuit having properties such that a loop antenna formed as one body with a wrist band for wearing on the wrist and a first variable capacity diode connected to the said loop antenna resonate at a specified frequency, characterized in furnishing b) a second variable capacity diode connected to the said antenna circuit, and c) a voltage generator that generates the applied direct current voltage of the said second variable capacity diode, in order to change the capacity of the said second variable capacity diode at any time, when the said loop antenna is worn on the wrist and when not worn.

Further, when such an antenna circuit is attached to a wrist radio instrument, the wrist radio instrument is constructed so that both are made as one body.

As stated above, the object of the present invention lies in automatically correcting changes in resonance frequency that arise because of changes in the inductance value of the loop antenna caused by the thickness of the wrist and by the condition of being worn on the wrist or not worn. As the means thereof, an electric coupling capacity is included in a connector part attached to the loop antenna, or a variable capacity diode is connected, and their electric coupling capacities are automatically changed. Generally, because the inductance increases as the loop antenna lengthens, the electric coupling capacity is decreased. Conversely, since the inductance decreases as the loop antenna becomes shorter, the electric coupling capacity is now increased. The resonance frequency can be kept set by making changes in this manner.

Also, in the case of inductance changes between times when worn on the wrist and when not worn, if counterbalancing direct current voltage changes are imparted from the voltage generator to the variable electrode, the electric coupling capacity can be automatically changed, and the resonance frequency can be held set.

Figure 1:
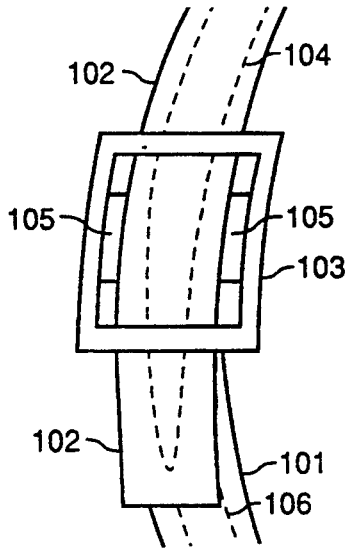
FIG. 1 is a drawing of an example showing the connector part of the loop antenna of the antenna circuit of the present invention.

| | |
|---|---|
| 101,102 | Wrist band |
| 103 | Buckle |
| 104,106 | Loop antenna |
| 104a,106a | Inductance of loop antenna |
| 105 | Metal plate |
| 107a | Electric coupling capacity of the connector part |
| 108a | Separate electric coupling capacity constructing the resonance circuit |
| 109a,109b | Terminals |
| 111 | Wrist band |
| 110 | Curve showing A (Δalpha) |
| 112 | Loop antenna |
| 113 | Velcro |
| 114 | Radio instrument main body |
| 201,201a,201b | Loop antenna |
| 202 | Connector |
| 203,209 | Resistances |
| 204 | Variable resistance |
| 205,207,210 | Condensers |
| 206 | Variable capacity diode for resonance frequency |

-continued

| | |
|---|---|
| | slippage compensation |
| 208 | Variable capacity diode for tuning |
| 211 | Ground |
| 212,214 | Direct current voltage application terminals |
| 213 | Radio frequency signal output terminal |
| 220 | Holes |
| 221 | Resistance panels |
| 222a,222b | Arm band |
| 223 | Projection |
| 224,225 | Metal fittings |
| 226 | Shaft |
| 227 | Hook |
| 228 | Tap metal fitting |
| 230,231 | Variable capacity diodes for resonance frequency slippage compensation |
| 232,233 | Variable capacity diodes for tuning |
| 234,235 | Radio frequency breaking choke coils |
| 236,237 | Condensers |
| 238,239 | Radio frequency signal output terminals |
| 301 | Loop antenna |
| 302 | Connector |
| 303,307,310 | Resistances |
| 304,305,308 | Condensers |
| 306,309 | Variable capacity diodes |
| 311,312,313, 315,303a | Terminals |
| 314 | Ground |
| 320 | Antenna circuit |
| 321 | Switch circuit |
| 322 | Frequency correction circuit |
| 323 | Frequency correction data output circuit |
| 324 | Radio frequency amplification circuit |
| 325 | Local oscillation circuit |
| 326 | Mixer circuit |
| 327 | Intermediate frequency amplification circuit |
| 328 | Detection circuit |
| 329 | Regeneration circuit |
| 330 | Tuning circuit |
| 331 | AGC circuit |
| 340,342,343 | Resonance characteristics |
| 341 | Signal gain with the radio not worn on the wrist, when the resonance frequency is $f_1$ |
| 344 | Signal gain with the radio worn on the wrist, when the resonance frequency is $f_2 + \Delta f$ |
| 345 | Signal gain with the radio worn on the wrist, when the resonance frequency is $f_2$ |
| 346 | Terminal 315 direct current voltage |
| 347 | Signal controlling AGC circuit 331, frequency correction circuit 322 and frequency correction data output circuit 323 |
| 348 | Output signal of frequency correction data output circuit 323 |
| 349 | Output voltage of frequency correction circuit 322 |
| 350 | Signal gain at frequency $f_1$ of antenna circuit 320 |
| 351 | Signal of intermediate frequency amplification circuit 327 |
| 352 | Signal for frequency correction data output circuit 323 to control switch circuit 321 |
| 353 | Time intervals for antenna circuit 320 maintaining the resonance frequencies respectively shown |

BEST MODE FOR WORKING THE INVENTION

FIG. 1 is an example of an antenna circuit, that provides an electric coupling capacity in the connector part of a loop antenna within the present invention, being used with a wristwatch band and connector. Wrist band segments 101 and 102 are made of an insulating material such as synthetic leather, and are mutually connected by buckle 103. Metal plate 105 is attached to buckle 103. Metal plate 105 is attached so that it traverses wrist band 102 intermediate on buckle 103, and as shown in the drawing, as seen from the front surface, it has a sufficiently large area compared to the area of buckle 103. Also, metal plate 105 is connected from its reverse surface to loop antenna 106, contained inside wrist band 101. Loop antenna 104 and 106 is made of a conductive body such as copper.

Loop antenna 104 inside wrist band 102 becomes narrower in width from side to side toward the end of wrist band 102. In the case of a person with a narrow wrist, wrist band 102 is placed in a positional relation such that the part where the lateral width of loop antenna 104 is long overlaps metal plate 105. That is, as the length around the wrist of wrist band 101 and 102 becomes shorter, the area where loop antenna 104 overlaps metal plate 105 becomes larger. Electric coupling capacity is generated at this overlapping part, and in this case the electric coupling capacity becomes larger.

On the other hand, in the case of a person with a thick wrist, the part where the lateral width of loop antenna 104 of wrist band 102 is short is placed in a positional relation where it overlaps metal plate 105. That is, as the length around the wrist of wrist band 101 and 102 becomes longer, the area where loop antenna 104 overlaps metal plate 105 becomes smaller. In this case, the electric coupling capacity becomes smaller.

Further, loop antenna 104 contained in the wrist band does not function as an antenna at the end part beyond metal plate 105. Consequently, what is meant by saying that the loop antenna is long, is that the part on the opposite side from metal plate 105 of the end of loop antenna 104 is long.

Figure 2:
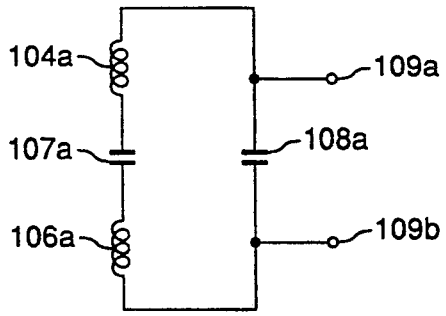
FIG. 2 is a drawing of an equivalent circuit of the antenna circuit of the present invention.

FIG. 2 is an electric equivalent circuit of the construction in FIG. 1. Loop antennas 104 and 106 are shown as coils, having inductances 104*a* and 106*a*. There is also electric coupling capacitor 107*a* where metal plate 105 and loop antenna 104 can overlap, and separate electric coupling capacitor 108*a* constructing a resonance circuit as shown in FIG. 2.

Electric coupling capacitor 108*a* is considered as being a fixed capacitor, or as a variable capacitor comprising an assembly of a variable capacitance diode and a fixed capacitor. It produces a high frequency signal using terminals 109*a* and 109*b* of capacity 108*a*, or one of the two.

By keeping the product of the sum of inductances 104*a* and 106*a* and the inverse number of the sum of the respective inverse numbers of electric coupling capacitors 107*a* and 108*a* set, it is possible to maintain the same resonance frequency constantly.

To express this by equations, taking inductances 104*a* and 106*a* as $L_{104a}$ and $L_{106a}$, taking electric coupling capacities 107*a* and 108*a* as $C_{107a}$ and $C_{108a}$, and taking the resonance frequency as f, we get the relation $$f = \frac{1}{2\pi\sqrt{(L_{104a} + L_{106a}) \cdot C_{total}}} \quad \text{(Equation 1)}$$

where $$C_{total} = \frac{1}{\frac{1}{C_{107a}} + \frac{1}{C_{106a}}} \quad \text{(Equation 2)}$$

f may be made a set value by $$(L_{104a} + L_{106a})\, C_{total} = C_{constant} \quad \text{(Equation 3)}$$

The value of electric coupling capacitor 107*a* that compensates for the changes in inductances 104*a* and 106*a*, when the length of loop antenna 104 and 106 becomes somewhat shorter, is obtained logically while maintaining the relation of Equation 3.

Inductances 104*a* and 106*a* are linked at radio frequency to buckle 103, and become a single inductance. When the value of this inductance is taken as $L_{total}$, we get $$L_{total}=K\mu o\ SN^2/l\ (=L_{104a}+L_{106a}) \quad \text{(Equation 4)}$$

Here, K is the Nagaoka coefficient, $\mu_0$ is the permeability in vacuum, S is the aperture area when loop antenna 104 and 106 is connected by buckle 103, N is the number of turns of the loop antenna, and l is the lateral width of the loop antenna. Aperture area S that constructs the loop antenna, taking the aperture part of the loop antenna as a circle and its radius as a, becomes $$S=\pi a^2 \quad \text{(Equation 5)}$$

Now, taking the length of the loop antenna as being considerably shorter, and taking the shortened quantity as Δalpha, the aperture area S' at this time is $$S' = \pi\left(a - \frac{\Delta\alpha}{2\pi}\right)^2 \quad \text{(Equation 6)}$$

Substituting Equation 6 for S in Equation 4, we obtain $L_{total}$ when the length of the loop antenna has become short.

The ratio of values of $L_{total}$ before and after the loop antenna has become short is proportional to the ratio of aperture area S, and its ratio $\Delta L_{total}$ is $$\Delta L_{total} = \frac{\left(a - \frac{\Delta\alpha}{2\pi}\right)^2}{a^2} \quad \text{(Equation 7)}$$

Looking at Equation 7, as Δalpha increases, $\Delta L_{total}$ becomes smaller than 1, and it will be understood that the value of $L_{total}$ will become smaller than Δalpha=0, that is when the length of the loop antenna does not change. Next, we obtain electric coupling capacity 107*a*.

$$C_{107a} = \epsilon\frac{A}{d} \quad \text{(Equation 8)}$$

Epsilon is the dielectric constant of the material, A is the area of the part where loop antenna 104 overlaps metal plate 105, and d is the distance between the metal surfaces of both. Epsilon is obtained from the dielectric constant of the minute space between the back surface of wrist band 102 and metal plate 105, and the material of wrist band 102 that covers loop antenna 104.

Here, when $C_{108a} >> C_{107a}$, the electric coupling capacity that affects the resonance frequency of the resonance circuit in FIG. 2 can be approximated by $C_{107a}$. Consequently, $$C_{total} \approx C_{107a} \quad \text{(Equation 9)}$$

As shown in Equation 3 and Equation 4, the product of $L_{total}$ and $C_{total}$ must be constant. Consequently, the value of $\Delta L_{total}$ when the loop antenna has become short, obtained by Equation 7, may be compensated by the ratio $\Delta C_{total}$ of the change in $C_{total}$. When we modify Equation 3 and express its meaning as equations, $$L_{total}\cdot\Delta L_{total}\cdot C_{total}\cdot\Delta C_{total}=C_{constant} \quad \text{(Equation 10)}$$

$$\Delta L_{total}\cdot\Delta C_{total}=1 \quad \text{(Equation 1)}$$

From Equation 11 and Equation 7, the ratio of change in the value of $\Delta C_{total}$ is $$\Delta C_{total} = \frac{a^2}{\left(a - \frac{\Delta\alpha}{2\pi}\right)^2} \quad \text{(Equation 12)}$$

From Equation 8 and Equation 9, the value of $\Delta C_{total}$ can be substituted for the change amount of area A of electric coupling capacity $C_{107a}$. Consequently, area A is seen as a function of Δalpha, and from Equation 12 we get $$A(\Delta\alpha) = \beta\frac{a^2}{\left(a - \frac{\Delta\alpha}{2\pi}\right)^2} \quad \text{(Equation 13)}$$

Beta is the area when Δalpha=0. When Δalpha decreases, that is, when the length of the loop antenna becomes shorter, the value of A (Δalpha) increases, and the value of $C_{107a}$ increases. Consequently, it becomes possible to compensate the ratio $\Delta L_{total}$ of the change in $L_{total}$.

Figure 3:
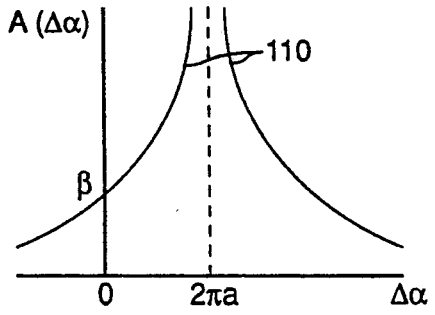
FIG. 3 is a showing the relation between area A (Δalpha) and change fraction Δalpha of the length of the loop antenna.

FIG. 3 is a graph representing Equation 13, where $\Delta L_{total}$ can be compensated by changing A (Δalpha) within the range $-\infty <$ Δalpha $<$ 2 pi. Thus, loop antenna 104 shown in FIG. 1 becomes narrower in width toward its end, and this width may be determined as the area where loop antenna 104 and metal plate 105 overlap, following Equation 13.

On the other hand, when $C_{108a} >> C_{107a}$ is not realized, it is also necessary to consider the value of $C_{108a}$ in $C_{total}$ but in this case although $C_{108a}$ is included in the equation for A (Δalpha), it may be obtained by theoretical computation, and the width of loop antenna 104 may be determined by its function.

In this manner, when the length of the loop antenna changes only by Δalpha, A (Δalpha) is automatically determined, thus determining electric coupling capacity $C_{107a}$ after compensation. $C_{107a}$ determined in this manner forms the resonance circuit together with $L_{total}$ when the length of the loop antenna has been shortened, and this resonance frequency will not change in comparison with before the length of the loop antenna was shortened. It is in this manner that the object of the present invention is achieved.

That is, in the case of a person with a narrow wrist, the circumferential length of loop antenna 104 and 106 contained in wrist band 101 and 102 around the wrist becomes shorter and its inductances 104*a* and 106*a* decrease, while the area where metal plate 105 and loop antenna 104 overlap increases and capacitance C107*a* increases. The fractional reduction of inductance 104*a* and 106*a* is made up for by capacitance C107*a*, and the product of the inverse number of the sum of the respective inverse numbers of inductance 104*a* and 106*a* and capacitance C107*a* and C108*a* is set.

Also, in the case of a person with a thick wrist, the circumferential length of loop antenna 104 and 106 becomes longer and its inductances 104*a* and 106*a* increase, while capacitance 107*a* decreases. The fractional increase of inductance 104*a* and 106*a* is offset by capacitance C107*a*, so that the product of the inverse number of the sum of the respective inverse numbers of inductance 104*a* and 106*a* and capacitances 107*a* and 108*a* is set.

Figure 4:
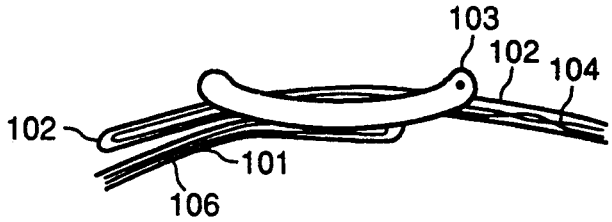
FIG. 4 is FIG. 1 seen from the side.

FIG. 4 is a drawing of the buckle portion of FIG. 1 seen from the side. Since wrist band 102 is merely inserted between buckle 103 and metal plate 105, it is simple to detach. Also, since buckle 103 presses against wrist band 102 at two places, it cannot easily slip out even when wrist band 102 is pulled from both sides.

Figure 5:
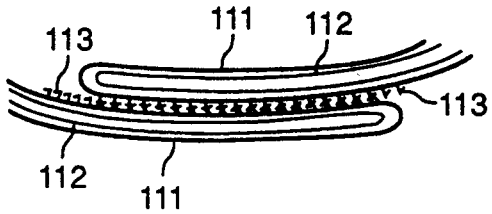
FIG. 5 is a drawing of an example showing the connector part of the loop antenna of the antenna circuit of the present invention.

FIG. 5 is a side sectional view of a wrist band using an antenna circuit identical to that in FIG. 1. Loop antenna 112 is contained inside wrist band 111. Velcro fibers 113 are attached in order to bring both sides of the wrist band into contact. Both sides of the wrist band can be connected by Velcro fibers 113, by overlapping them in the desired position.

When thus overlapped, when the circumferential length of wrist band 111 is short, the area where loop antenna 112 overlaps is large, and has a large capacity. On the other hand, when the circumferential length of wrist band 111 is long, the area where loop antenna 112 overlaps is small, so that the capacity here is small.

Figure 6:
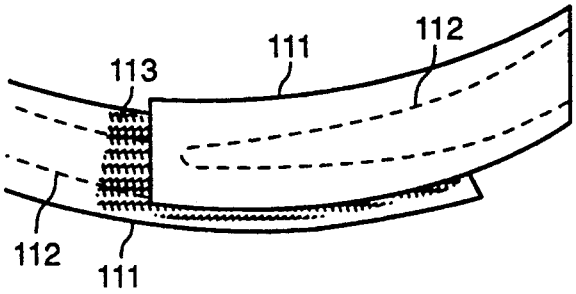
FIG. 6 is FIG. 5 seen from an angular direction.

FIG. 6 is a drawing of the example in FIG. 5 seen from an angular direction. In this case also, the electrical equivalent circuit is the same as in FIG. 2, as the length of loop antenna 112 changes the overlap area of loop antenna 112 changes automatically, and since electric coupling capacitance C107*a* changes, the resonance frequency can always be maintained at a set value.

The narrow portion of the lateral width of loop antenna 112 may also be determined so as to satisfy Equation 13.

Figure 7:
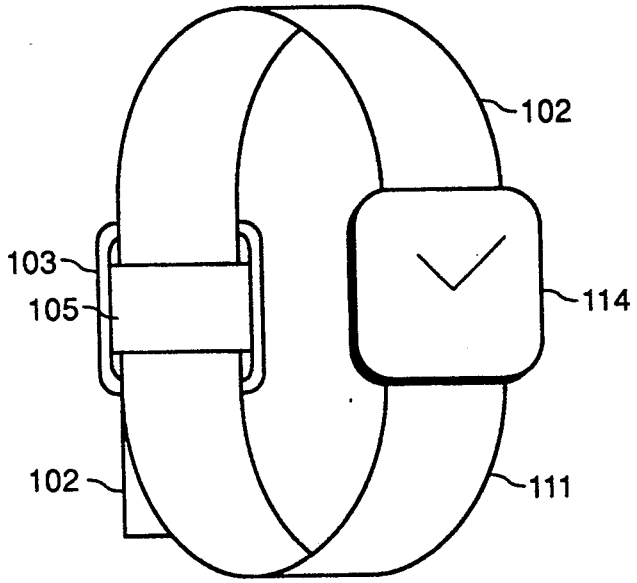
FIG. 7 is a drawing of an example of the antenna the present invention applied to a wrist radio instrument.

FIG. 7 is an example of the present invention utilized in a wristwatch type radio instrument. Main body 114 contains the radio instrument. This very simple style that does not give the, impression of there being a radio is well suited for simple transmitter-receivers and selective call receivers.

Figure 8:
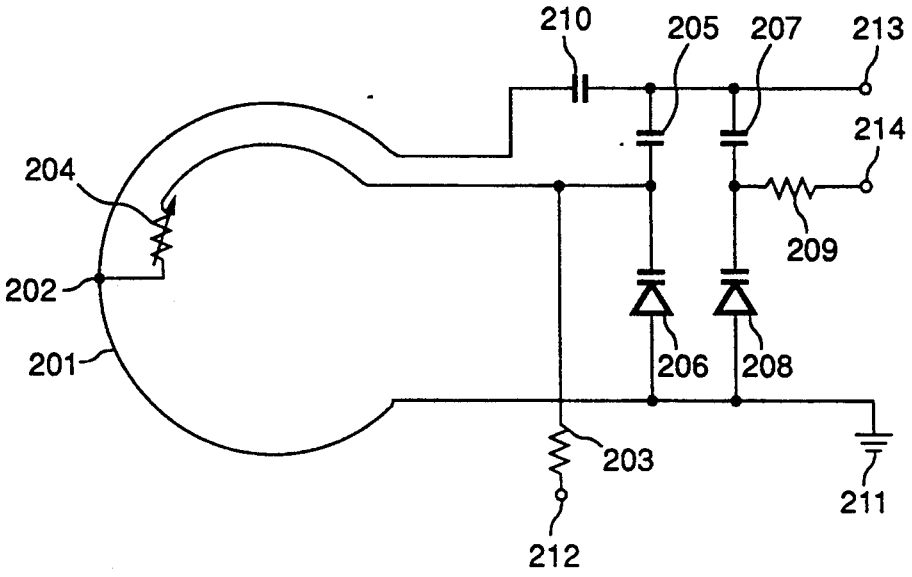
FIG. 8 is a drawing of an example of the antenna circuit of the present invention.
Figure 9:
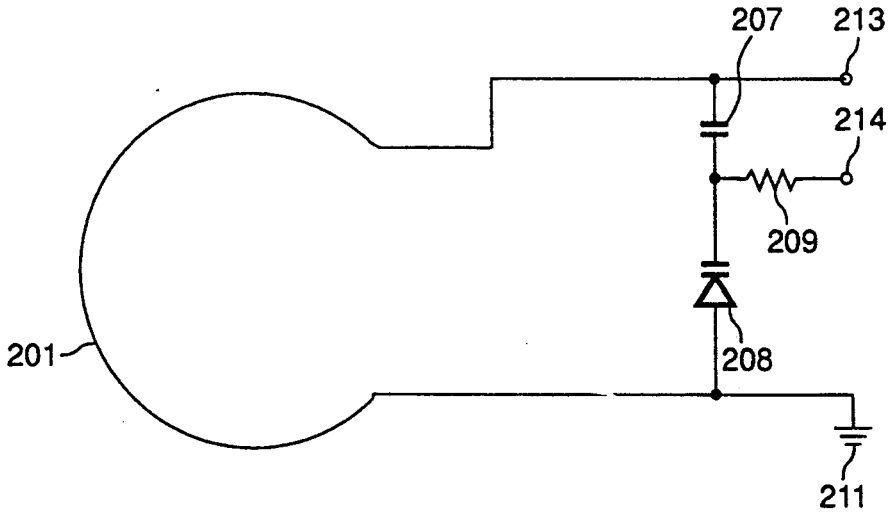
FIG. 9 PRIOR ART
FIG. 9 is a drawing of an example of a prior circuit.

FIG. 8 is an antenna circuit diagram showing a variable capacity diode installed in an antenna circuit, within the present invention. FIG. 9 is an antenna circuit used previously. This also shows an example where changes in resonance frequency are suppressed by changes in the length of the loop antenna.

As shown in FIG. 8, loop antenna 201 is constructed so that it can be detached at the connector 202 part and so that it connects connector 202 electrically, and loop antenna 201 and variable resistor 204 are connected. This variable resistance 204, with resistance 203, determines the direct current voltage of variable capacity diode 206. Power source voltage is supplied from terminal 212. This power source is one that always generates a set voltage. Loop antenna 201 is grounded by ground 211. Consequently, the voltage applied to variable capacity diode 206 is determined by the resistance ratio of resistor 203 and variable resistor 204. Further, when the resistance of variable resistor 204 is changed, the voltage applied to variable capacity diode 206 changes, making it possible to change the capacity. The resistance value of variable resistor 204 has a large value of several tens to a hundred kiloohms, so that there cannot be a decrease in the Q as the resonance circuit of the antenna circuit, including loop antenna 201, and there is no decrease in the sensitivity of the antenna circuit.

Condensers 205, 207 and 210 are used for direct current cutting.

Variable capacity diode 208 is essentially used for tuning. Direct current voltage used for tuning is applied from terminal 214 via resistance 209. Previously, as shown in FIG. 9, an antenna circuit was also constructed by variable capacity diode 208 and condenser 207, and then by loop antenna 201. This variable capacity diode 208 did away with dispersion of the resonance frequency of the antenna circuit in a case when the object was to keep the antenna circuit constantly resonating at the same frequency, and if there was no dispersion, could be substituted for by a simple condenser.

However, since the object of the present invention is to compensate automatically for resonance frequency slippage when there is a change in the length of the loop antenna, it has a major characterizing feature in that variable capacity diode 206 is added therein as an antenna circuit for realizing this object.

Figure 10:
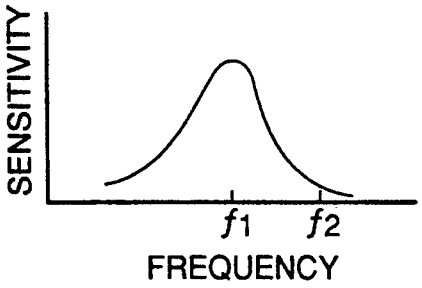
FIG. 10 PRIOR ART
FIG. 10 is a drawing showing the resonance characteristics of the prior art antenna circuit when the length of the loop antenna is long.
Figure 11:
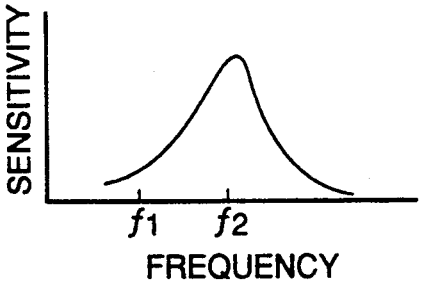
FIG. 11 PRIOR ART
FIG. 11 is a drawing showing the resonance characteristics of the prior art antenna circuit when the length of the loop antenna is short.

FIG. 10 is a diagram showing the resonance properties of the antenna circuit when the length of loop antenna 201 is long, using an antenna circuit that was in prior use as in FIG. 9, while FIG. 11 is a diagram showing the resonance properties of the same when the length of loop antenna 201 is short.

When the length of loop antenna 201 is long, the sending station of low frequency $f_1$ is received because the inductance of loop antenna 201 increases. When the length of loop antenna 201 becomes shorter, its inductance becomes smaller, so that the sensitivity to $f_1$ received up to now decreases, while on the other hand the sensitivity to radio frequency $f_2$ increases. That is, tuning slippage occurs because of changes in the length of loop antenna 201.

By following the antenna circuit of the present invention, it is possible to prevent tuning slippage arising from such causes.

In FIG. 11, the capacity of variable capacity diode 206 increases in order to keep maximum sensitivity coming in frequency $f_1$, because inductance decreases only in the part where loop antenna 20 has become shorter. In order to increase the capacity of variable capacity diode 206, direct current voltage applied to the cathode side decreases. In order to decrease the direct current voltage, variable resistance 204 may be made smaller. This variable resistance 204 comprises the connector 202 part and resistance panels 221 formed inside the wrist band. By doing it this way, even if loop antenna 201 becomes shorter, the frequency can be maintained at $f_1$. In regard to the value of resistance panels 221, since increase and decrease in inductance is compensated by using this value, the $\Delta C_{total}$ of Equation 12 can be utilized as the capacity to compensate for the inductance change $\Delta L_{total}$. That is, when the loop antenna length has shortened just by Δalpha, the change amount of equivalent capacity connected in parallel to the loop antenna is $\Delta C_{total}$, so that the value of variable capacity diode, 206 may change momentarily following the change amount of $C_{total}$ in Equation 12. In essence, only the appropriate direct current voltage need be applied in variable capacity diode 206. This also means that only the required resistance need be provided.

Figure 12:
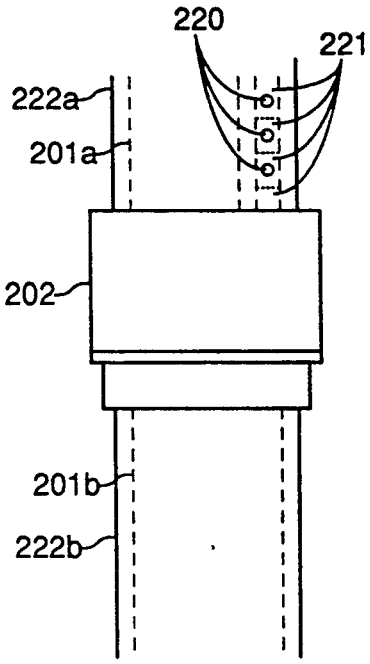
FIG. 12 is a drawing explaining the scheme of variable resistance in the connector part when the antenna circuit of the present invention is applied to a wrist radio instrument.

FIG. 12 is a diagram showing the construction of variable resistor 204. Loop antenna 201*a* and 201*b* contained inside wrist band 222 are connected by connector 202. Resistance panels 221 are also contained in wrist band 222*a* alongside loop antenna 201*a*. Resistance panels 221 connect as sections having respectively different resistance values, and in each one of them are holes 220 capable of passing electric current. These holes 220 have a construction such that they pierce through from the front surface of the wrist band to the back surface. One hole 220 links with a projection inside connector 202, joining it to loop antenna 201*b*.

Figure 13:
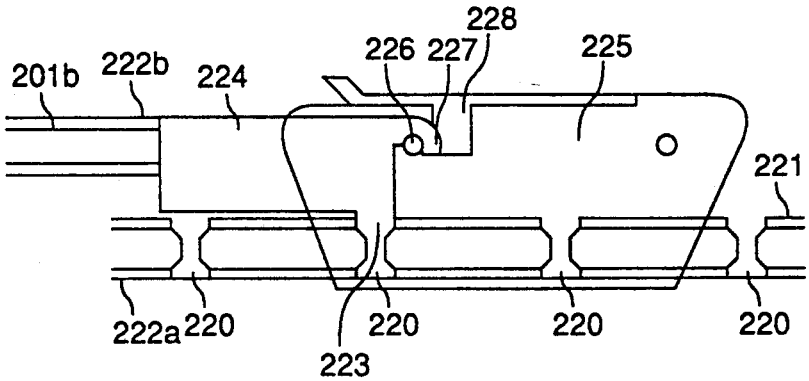
FIG. 13 is a vertical sectional view of the connector part.

FIG. 13 is a vertical sectional view of connector 202. At the tip of loop antenna 201*b* is furnished metal fitting 225 between metal fitting 224 and wrist band 222*a* having loop antenna 201*a*. Metal fittings 224 and 225 are electrically conductive with loop antenna 201*a* and 201*b*, and shaft 226, hook 227 and tap metal fitting 228 are used to couple the two. Loop antenna 201*a* and 201*b* are conected under pressure from these three metal fittings.

Metal fitting 224 has projection 223. This is inserted into one hole 220 furnished in a side of wrist band 222*a*. Hole 220 is an opening in resistance panels 221 and leads through electrically. Projection 223 and hole 220 are respectively constricted in their sections, for reliable passage of electric current. In this manner, resistance panels 221, metal fitting 224 and also loop antenna 201*b* are connected.

Projection 223 becomes inserted into hole 220 on the tip side of loop antenna 201*a* when loop antenna 201 becomes longer. When this happens, a resistance value is applied in variable capacity diode 206 from projection 223, utlizing the fact that the length of resistance panels 221 has become longer. Consequently, the voltage applied to the cathode of variable capacity diode 206 increases, the capacity decreases to a form that compensates for the increase in conductance in loop antenna 201, and as a result, a set sensitivity can be maintained without tuning slippage.

Conversely, when loop antenna 201 becomes shorter, it is inserted into the hole 220 on the radio instrument side of loop antenna 201*a*, so that the fact that resistance panels 221 have shortened is utilized, the applied voltage drops, and the capacity of variable capacity diode 206 increases to a form that compensates for the decrease in the inductance of loop antenna 201, making it possible to avoid tuning slippage.

In this manner, any tuning slippage is automatically compensated for, even if the length of the wrist band of the present invention, made as one body with the loop antenna and using the antenna circuit of the present invention, is changed, and this makes it possible to maintain sensitivity in a constantly set condition.

Figure 14:
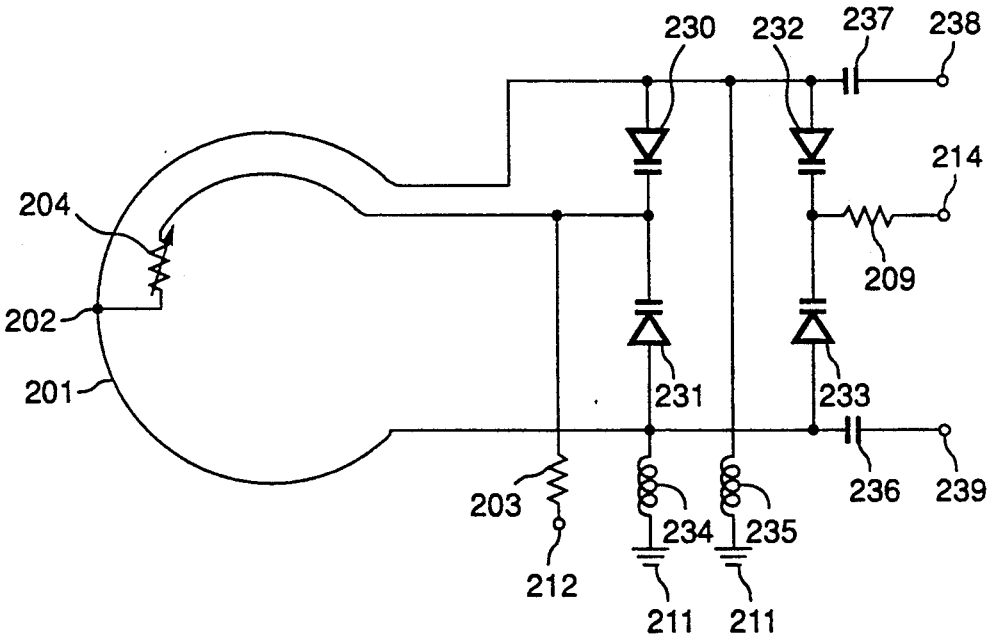
FIG. 14 is a drawing of an example of the antenna of the present invention.

Further, it may go without saying that the invention can be applied to a circuit where the antenna circuit is a balanced output type, as shown in FIG. 14.

Figure 15:
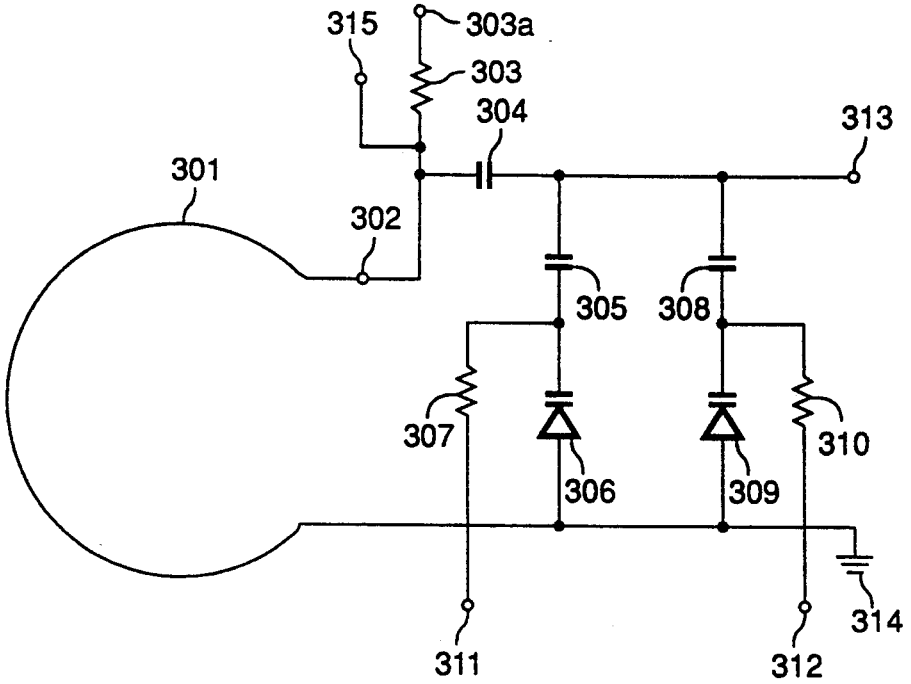
FIG. 15 is a drawing of an example of the antenna of the present invention.

FIG. 15 is an antenna circuit diagram with a variable capacity diode installed in an antenna circuit, within the present invention, and differs in its object from the example in FIG. 8. FIG. 15 shows an example where slippage in the resonance frequency of the antenna circuit is automatically compensated when the loop antenna is worn on the wrist and when not.

Loop antenna 301 is made so that it can be detached at the connector 302 part. Connector 302 plays the role of a switch giving direct current electric connection to the loop antenna 301 side and the condenser 304 side. Connector 302 may be in any position on loop antenna 301. Direct current voltage is imparted from terminal 303*a* via resistor 303. Terminal 315 is a terminal that monitors the direct current voltage. Condenser 305 and variable capacity diode 306 connected in series are condensers furnished so that the radio instrument can be tuned to the object frequency. They are, so to speak, condensers for tuning. Direct current voltage for, tuning is imparted from terminal 311 via resistor 307, to determine the capacity of the variable capacity diode.

A characterizing feature of the antenna circuit of the present invention, as said above, lies in the point that it furnishes variable capacity diode 309 and condenser 308 connected thereto in series, and further, terminal 312 and resistor 310 for applying direct current voltage, separately from variable capacity diode 306 used for station selection.

First, in a condition where loop antenna 301 is not around the wrist, tuning is enabled by constructing loop antenna 301 and a resonance circuit using station selection condenser 305 and variable capacity diode 306. In this condition, loop antenna 301 is detached by part of connector 302, and here loop antenna 301 is connected at connector 302 when it goes around the wrist.

In so doing, the value of the inductance of loop antenna 301 changes from the effect of the human wrist, and the resonance frequency of the antenna circuit slips compared to the case when it is not on the wrist. Here, the antenna circuit is retuned to the resonance frequency when it was originally not on the wrist, by changing the direct current voltage applied to variable capacity diode 310 and by equivalently changing the capacity of the condenser connected in parallel to loop antenna 301. By these means it is possible to maintain a stable sensitivity of the radio instrument, with no slippage in resonance frequency from the effect of the wrist. Of course, it is also possible to adjust slippage in resonance frequency by these operations, in cases when it was first placed around the wrist, and then removed from the wrist.

Radio frequency signals of the radio instrument can be given stabilized output by amplifying with a radio frequency circuit connected to the end of terminal 313.

Figure 16:
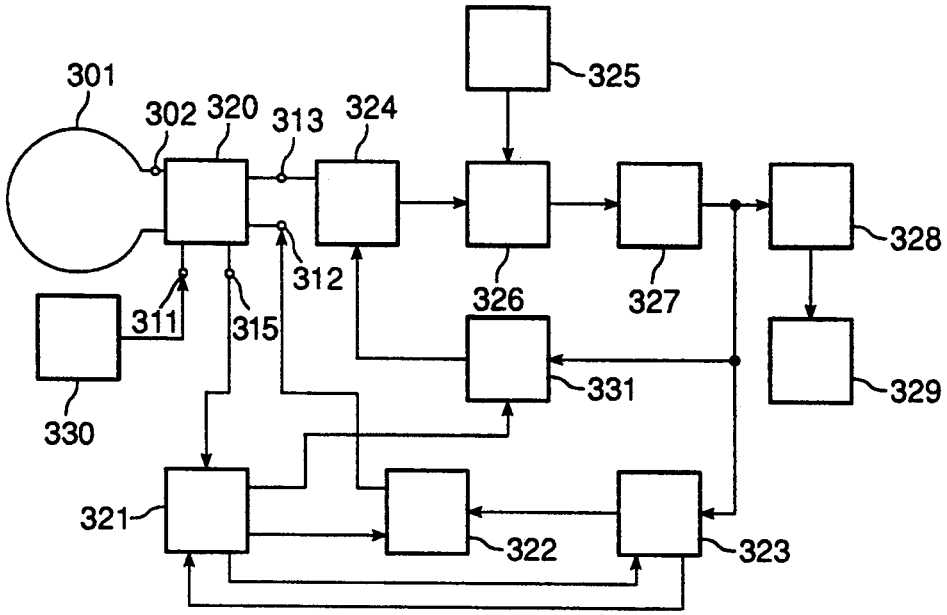
FIG. 16 is a circuit block diagram showing an example of a wrist radio instrument with the antenna circuit of the present invention assembled therein.

FIG. 16 is a circuit block diagram showing an example of a wrist mounted receiver instrument with the antenna circuit of the present invention assembled therein.

The signal received by loop antenna 301 passes through antenna circuit 320 of the present invention, is amplified by radio frequency amplification circuit 324, is mixed with the signal from local oscillation circuit 325, and is converted to an intermediate frequency. Then, it passes through amplification circuit 327, is detected by detection circuit 328, and the demodulated signal is treated by regeneration circuit 329 to obtain the various types of information signals.

For example, we first suppose the case where it is not worn on the wrist. In this state, direct current voltage from tuning circuit 330 is applied to terminal 311, it is tuned to frequency $f_1$, and a radio frequency signal is received. AGC circuit 331 is connected at the output of intermediate frequency amplification circuit 327 for the purpose of tuning the gain of radio frequency amplification circuit 324. By means of this circuit, the input signal of detection circuit 328 is kept constantly at a set level.

Figure 17:
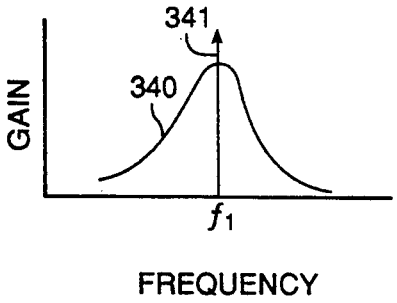
FIG. 17 is a drawing showing the resonance characteristics of the antenna circuit when not worn on the wrist, when the resonance frequency is $f_1$.

FIG. 17 is a spectrum diagram showing the resonance properties of the antenna circuit in this state. Signal spectrum 341 is at the frequency of the largest gain of resonance characteristics 340.

Next, we suppose that connector 302 is detached and loop antenna 301 is cut off from antenna circuit 320. When this is done, the voltage of terminal 315, although one of ground potential up till now, rises to the power source potential. Loop antenna 301 for wearing on the wrist is in a state where it circumscribes the wrist, and connector 302 is connected. When this is done, terminal 315 again has a ground potential. Here, there is no change in the direct current voltage from tuning terminal 330. However, when terminal 315 has taken the ground potential, a signal that stops the operation of AGC circuit 331 is output at switch circuit 321. Also, a signal for operating frequency correction circuit 322 is output. Further, a signal for operating frequency correction data output circuit 323 is also output.

In this state, since AGC circuit 331 does not operate, the output of intermediate frequency amplification circuit 327 is proportional to the output level of antenna circuit 320. Thus, the resonance frequency of the antenna circuit, because of being worn on the wrist, slips from frequency $f_1$ before wearing, to become $f_2$. At this time, frequency correction data output circuit 323 outputs a signal such that shifts the resonance frequency only by the minute frequency fraction $\Delta f$, relative to the presently resonating frequency $f_2$.

Receiving this signal, frequency correction circuit 322 outputs direct current voltage correcting the $\Delta f$ fraction, it is applied to terminal 312, and antenna circuit 320 takes the resonance frequency $f_2+\Delta f$.

Figure 18:
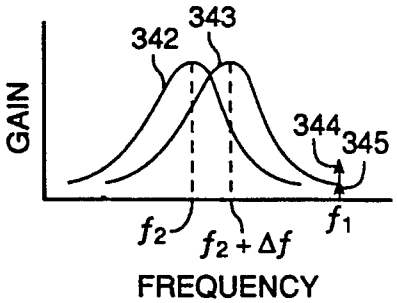
FIG. 18 is a drawing showing the resonance characteristics, of the antenna circuit when worn on the wrist, when the resonance frequency has reached $f_2$ and $f_2+\Delta f$.

FIG. 18 is a diagram showing the resonance properties when the resonance frequency has become $f_2+\Delta f$. At this time, a level signal proportional to the resonance properties of antenna circuit 320 is obtained in the output of intermediate frequency amplification circuit 327. Accordingly, in this case the level of this output is increased only by the fraction that signal gain 345 has added to signal gain 344. This output is compared to the remembered level at the time of resonance frequency $f_2$, before being input to frequency correction data output circuit 323, and when it is larger, the $f_2+\Delta f$ frequency is selected. When it is smaller, the $f_2$ frequency is selected. When the $f_2+\Delta f$ level is larger, that is, when it has been added to signal gain 334 as in the case of FIG. 16, frequency correction data output circuit 323 further puts out a signal that resonates at a frequency higher by the $\Delta f$ fraction only. Receiving this signal, frequency correction circuit 322 newly determines the direct current voltage, applies the direct current voltage to terminal 312, and antenna circuit 320 has its resonance frequency brought into correspondence with $f_2+2\Delta f$. Then, the level of intermediate frequency amplification circuit 327 is compared to the level of the resonance frequency of $f_2+\Delta f$ detected one time before, that is, to the level proportional to signal 344 in FIG. 18, and when the resonance frequency is larger, then frequency correction data output circuit 323 is selected.

Figure 19:
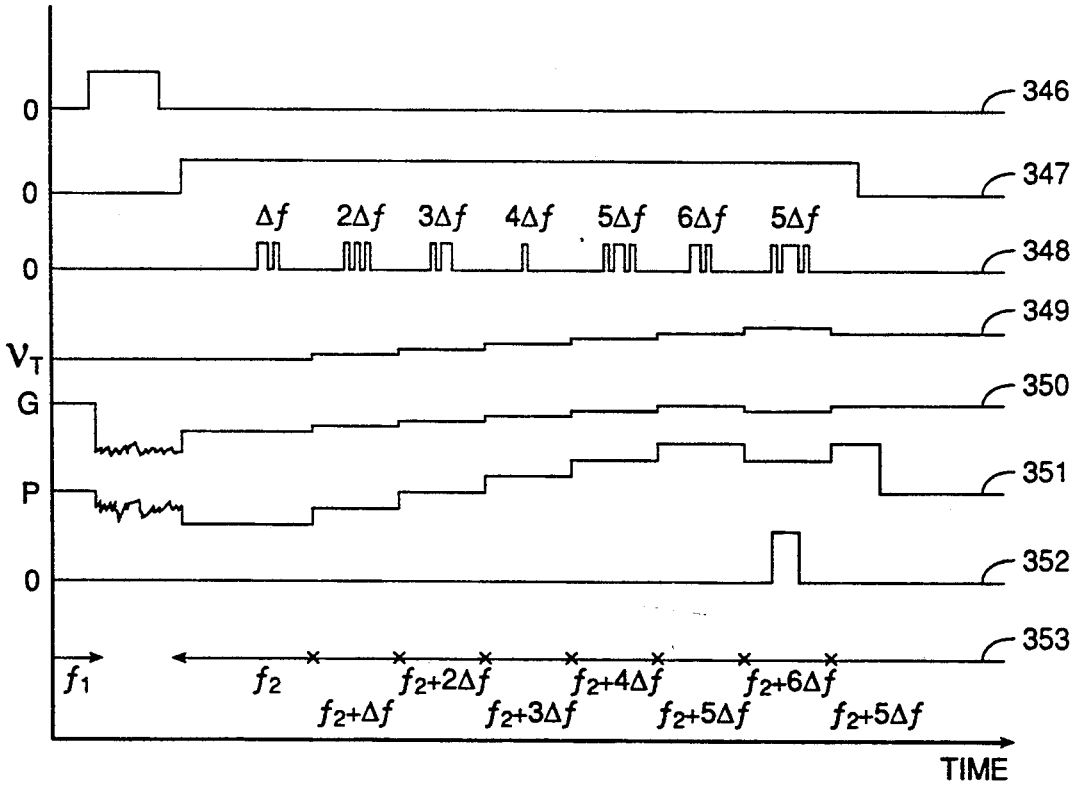
FIG. 19 is timing chart diagram showing signal changes in the circuit that operate so that the antenna circuit of the present invention automatically corrects slippages in resonance frequency.

Repeating this series of operations, when the output level of intermediate frequency amplification circuit 327 at $f_2+n\Delta f$ (n is an integer) goes below the level at $f_2+(n-1)\Delta f$, frequency correction data output circuit 323 ultimately selects the resonance frequency as $f2+(n-1)\Delta f_1$, and outputs the signal to frequency correction circuit 322. Then, receiving this signal, frequency correction circuit 322 outputs the newly set final direct current voltage. Also, at the same time, a correction termination signal is produced for switch circuit 321. Switch circuit 321 receives the correction termination signal, holds the signal that stops the operation of frequency correction data output circuit 323 and the final direct current voltage of frequency correction circuit 322, and puts out a signal that stops this operation. Further, a signal for again operating AGC circuit 331 is output, and sent to AGC circuit 331. In this m n-ner, the frequency correction operation is terminate FIG. 19 is a timing chart diagram showing signal changes of the circuits that operate to correct resonance frequency slippage automatically.

The sequence of operations described above are displayed in this diagram.

Before being worn on the wrist, antenna circuit 320 had resonance frequency $f_l$, but the arm band connector is detached in order to place the band on the wrist. When this is done, voltage 346 of terminal 315 rises to the power source voltage. At this time, there is almost no signal gain 350 at frequency $f_1$ in antenna circuit 320 because of the loop antenna being cut off. So next, the wrist band is placed on the wrist. When this is done voltage 346 of terminal 315 decreases to a ground potential. Because of this, signal 347 that controls them rises to the power source voltage, in order to stop AGC circuit 331 and in order to operate frequency correction data output circuit 323 and frequency correction circuit 322.

When frequency correction data output circuit 323 outputs signal $\Delta f$ with correction signal 348, frequency correction circuit 322 changes the resonance frequency from $f_2$ to $f_2+\Delta f$, so that direct current voltage 349 increases a little. When this happens, signal gain 350 in frequency $f_1$ of antenna circuit 320 also increases a little, and the signal 351 level of intermediate frequency amplification circuit 327 also increases a little. At this time, since AGC circuit 331 is stopped, it is proportional to the signal gain 350 level at frequency $f_1$ of antenna circuit 320.

Because the signal 351 level of intermediate frequency amplification circuit 327 has increased, frequency correction data output circuit 323 puts out signal $2\Delta_f$ with correction signal 348, in order to do the next correction and in order to change the resonance frequency to $f_2+2\Delta f$.

While repeating these steps, output signal 351 of intermediate frequency amplification circuit 327 searches for the largest $n\Delta f$.

In FIG. 19, the signal 351 level of intermediate frequency amplification circuit 327 first drops after correction to $6\Delta f$, so that frequency correction data output circuit 323 puts out signal $5\Delta f$ with correction signal 348 in order to change the resonance frequency to $f_2+\Delta f$, the one before, and inputs signal 352 to switch circuit 321. The trigger pulse of signal 352 is detected, signal 347 controlling frequency correction data output circuit 323 and frequency correction circuit 322 falls, and frequency correction circuit 322 stops while holding direct current voltage 349 from the time of $f_2+5\Delta f$. Then, AGC circuit 331 and controlling signal 347 also fall simultaneously, and AGC circuit 331 operates again. Then, the signal 351 level of intermediate frequency amplification circuit 327 returns to the level before the series of correction operations, and the correction operations terminate.

In the above manner, the tuning frequency of antenna circuit 320 while being worn on the wrist is generally $f_2+(n-1)\Delta f$, and when $\Delta f$ is made smaller, it approaches frequency $f_1$, for the time when not worn, infinitely.

Frequency difference $\Delta f$ for a single correction makes its determination by considering the time needed for the correction and the correction precision.

The algorithm that obtains a resonance frequency that maximizes the signal 351 level of the output of intermediate frequency amplification circuit 327 during the correction operation can be created by computer, using any technique for obtaining the maximum value of the data.

In this manner, it is possible to correct resonance frequency $f_2$ when worn on the wrist, and frequency $f_1$ when not worn. These operations are all done automatically, making it possible to perform resonance frequency corrections with no inconvenience to the user whatsoever.

Also, it is also possible to do away with differences in reception sensitivity, resulting from frequency slippage between times when worn on the wrist and times when not worn.

Also, the example in FIG. 15, as said above, is used for the object of automatically compensating for resonance frequency slippage in the antenna circuit, when the loop antenna is either worn or not worn on the wrist, and simultaneously also compensates for resonance frequency slippage of the antenna circuit that happens when the length of the loop antenna is changed. This is because the length of the loop antenna changes only when the the loop antenna connector is detached to change the length and remounted on the wrist. Slippage in the resonance frequency of the antenna circuit at this time occurs from two causes, because of effects from the wrist and because of change in the length of the loop antenna. But when this example is used, it detects the resonance frequency slippage and automatically compensates this resonance frequency. Simply because of this, it can be used when the loop antenna length has been changed, with the result that it is very effective as a means of compensating for loop antenna resonance signal slippage occurring from various causes.

As said above, the antenna circuit of the present invention makes it possible to tune to a constantly set frequency by automatically compensating for resonance frequency slippage, in order to prevent the resonance frequency of the antenna circuit from being changed by such as loop antenna length or the wrist thickness of the person wearing it, when worn on the wrist or when not worn.

Also, wrist radio instruments furnished with such an antenna circuit can receive automatically set resonance signals stabilized at a set sensitivity, regardless of changes in wearer wrist thickness or changes in wrist band length, and without making special adjustments when wearing the radio instrument on the wrist or not wearing it.

I claim:

1. A wrist-mounted radio instrument including a radio receiver, comprising:

a) a wrist band having two portions;

b) a connector assembly having a first portion mounted on a first one of said two wrist band portions, and a second portion mounted on a second one of said two wrist band portions, said connector assembly operable to detachably connect said wrist band portions so that said wrist radio instrument may be removably attached to a human wrist;

c) a loop antenna embedded within said wrist band;

d) a means for detecting electrical connection of said wrist band portions;

e) a means, coupled to said wrist band, for automatically engaging a frequency correction circuit for a predetermined period of time, upon detection of the electrical connection of said wrist band portions;

f) a first variable capacity diode electrically coupled to said loop antenna; and g) a first voltage generation circuit for generating a DC voltage connected to said variable capacity diode for changing the capacity of said variable capacity diode in correspondence with changes in the circumferential length of said loop antenna;

wherein said first voltage generation circuit comprises:

1) a voltage supply circuit having a positive terminal and a ground terminal;

2) a fixed resistor having first and second terminals; and 3) a variable resistor having first and second terminals;

said fixed resistor first terminal and said variable resistor first terminal being electrically connected in series so as to form a common node, said common node being connected to said first variable capacity diode, said positive terminal being electrically connected to said fixed resistor second terminal, and said variable resistor second terminal being electrically connected to said ground terminal.

* * * * *